US009970434B2

(12) United States Patent
McKinzie et al.

(10) Patent No.: US 9,970,434 B2
(45) Date of Patent: May 15, 2018

(54) MOTOR, CONTROLLER AND ASSOCIATED METHOD

(71) Applicant: Regal Beloit America, Inc., Beloit, WI (US)

(72) Inventors: Marc Christopher McKinzie, West Wilton, OH (US); John Sheldon Wagley, Winona Lake, IN (US)

(73) Assignee: Regal Beloit America, Inc., Beloit, WI (US)

( * ) Notice: Subject to any disclaimer, the term of this patent is extended or adjusted under 35 U.S.C. 154(b) by 347 days.

(21) Appl. No.: 14/714,325

(22) Filed: May 17, 2015

(65) Prior Publication Data

US 2016/0333873 A1 Nov. 17, 2016

(51) Int. Cl.
*F04B 49/06* (2006.01)
*F04B 17/03* (2006.01)

(52) U.S. Cl.
CPC ..... *F04B 49/065* (2013.01); *F04B 17/03* (2013.01)

(58) Field of Classification Search
CPC ..... F04B 49/065; F04B 17/03
See application file for complete search history.

(56) References Cited

U.S. PATENT DOCUMENTS 5,151,017 A 9/1992 Sears et al.
5,430,931 A 7/1995 Fisher et al.
5,725,359 A 3/1998 Dongo et al.
5,730,861 A 3/1998 Sterghos et al.
6,157,304 A 12/2000 Bennett et al.
6,342,841 B1 1/2002 Stingl
6,806,677 B2 10/2004 Kelly et al.
7,690,897 B2 4/2010 Branecky et al.
7,988,425 B1 8/2011 Stingl
8,177,519 B2 5/2012 Branecky
8,177,520 B2 5/2012 Mehlhorn et al.
8,378,618 B2 2/2013 Zavodny et al.
8,546,984 B2 10/2013 Heilman et al.
8,602,743 B2 12/2013 Stiles, Jr. et al.
8,801,389 B2 8/2014 Stiles, Jr. et al.
8,820,355 B2 9/2014 Sutton et al.
8,981,684 B2 3/2015 Drye et al.
(Continued)

FOREIGN PATENT DOCUMENTS

WO 2010118121 A1 10/2010

*Primary Examiner* — Vincent Tran
*Assistant Examiner* — Vincent Chang
(74) *Attorney, Agent, or Firm* — John Wagley

(57) ABSTRACT

According to an embodiment of the invention, a system for managing commands for a pump electric motor for powering a pump for use in a pool and/or a spa is provided. The system includes a user interface for receiving user commands from a user and a pump motor controller for controlling the pump electric motor. The user interface and/or the pump motor controller is adapted to receive first protocol commands utilizing a first protocol from a first input source and adapted to send first input source signals corresponding to the first protocol commands to a portion of the pump motor controller. The user interface and/or the pump motor controller is further adapted to receive second protocol commands utilizing a second protocol from a second input source and adapted to send second input source signals corresponding to the second protocol commands to a portion of the pump motor controller.

13 Claims, 6 Drawing Sheets

(56) References Cited

U.S. PATENT DOCUMENTS

| | | | | |
|---|---|---|---|---|
| 2004/0032235 | A1* | 2/2004 | Takei | G05B 19/414 318/696 |
| 2007/0154322 | A1* | 7/2007 | Stiles, Jr. | F04B 49/20 417/44.1 |
| 2008/0159280 | A1* | 7/2008 | Hwang | H04W 76/025 370/389 |
| 2009/0038696 | A1 | 2/2009 | Levin et al. | |
| 2009/0151801 | A1 | 6/2009 | Gorman et al. | |
| 2012/0016525 | A1 | 1/2012 | Davis et al. | |
| 2012/0053737 | A1* | 3/2012 | Valluri | H02J 3/14 700/276 |
| 2012/0219428 | A1 | 8/2012 | Cantolino et al. | |
| 2012/0308402 | A1 | 12/2012 | Le et al. | |
| 2013/0104306 | A1 | 5/2013 | McKinzie | |
| 2013/0108476 | A1 | 5/2013 | Guzelgunler | |
| 2013/0118705 | A1 | 5/2013 | Potter | |
| 2013/0216398 | A1 | 8/2013 | Stephens | |
| 2014/0018961 | A1* | 1/2014 | Guzelgunler | F04B 49/065 700/275 |
| 2014/0271235 | A1 | 9/2014 | Magyar | |
| 2014/0277776 | A1 | 9/2014 | McKinzie | |
| 2015/0132148 | A1 | 5/2015 | Afshar | |
| 2015/0211511 | A1 | 7/2015 | Koehl | |

* cited by examiner

100

20

22

| Priority | Description |
|---|---|
| 1 | Utility protocol |
| 2 | Customer #1 protocol |
| 3 | Customer #2 protocol |
| 4 | Regal protocol |

| Utility Protocol command | Translated Regal Protocol command | Beginning speed command | Changed speed command |
|---|---|---|---|
| | | [RPM} | [RPM} |
| Reduce load | Reduce current speed by 50% | 2600 | 1300 |
| Shed load | Reduce current speed to 0% | 2600 | 0 |
| Increase load | Increase current speed by 100% | 2600 | 3450 |

54

| | |
|---|---|
| PRIORITY STRUCTURE | |
| MESSAGE STRUCTURE | 66 |
| MESSAGE CHECK SUM | 68 |
| MESSAGE DATA LENGTH | 70 |
| MESSAGE BAUD RATE | 72 |

FIG. 5

MOTOR, CONTROLLER AND ASSOCIATED METHOD

BACKGROUND OF THE INVENTION

The embodiments described herein relate generally to fluid moving devices and controller, and more specifically, to a pump motor controller.

Pool and spa pumps are used to circulate water within the pool. The circulation of the water disperses chemicals added to the water to provide for acceptable water conditions. The circulation also permits the passage of water through a filter to remove imparities from the water. Typically the pump operates for a portion of fee week, typically on a schedule. The pump is typically powered by an electrical motor. The motor may be manually operated, wherein the operator manually controls the pump weekly cycle by manually turning the pump motor off and on.

Energy consumption tends to vary during different days of the week and different times of the day. Energy provided by the energy providers must be capable of meeting the demands of the times of highest energy consumption. Due to the enormous capital expenses required to provide electrical power to residential consumers, energy providers have devised methodologies to discourage energy use at those times of highest energy consumption.

Among the methodologies to discourage energy use at those times of highest energy consumption are control devices supplied by the energy provider. Such control devices are connected to the residential consumers power supply and may be used to reduce or curtail certain energy use by the consumer. These control devices communicate with the power loads of the consumer. Power loads include, for example, appliances, lighting, climate devices for heating and cooling including heating elements and motors, and pool and spa pump motors including other related equipment.

Pool and spa pump motors are one power load for which energy consumption can be scheduled tor use at times of lower energy consumption or be reduced at period of higher energy use. Scheduling such consumption can be difficult or inconvenient, particularly where the methodologies are complex.

Some even more sophisticated pool pump systems have electronic controllers located in or adjacent the pool pump motors or within a pool system. These electronic controllers regulate the operation of the pool pump. These electronic controllers determine the on and off times of the pool pump motor. They may also control the speed of the pump if the pool pump motor has more than one possible speed.

These sophisticated electronic controllers communicate with the control devices supplied by the energy provider. Such communication is done using a protocol provided by the energy provider. A number of protocols are available for such communications between the energy provider's control devices and pool pump electronic controllers. Typically a pool pump electronic controller would need a separate communicating/translating device provided by the energy provider so that the energy provider's control device could communicate with the pool pump electronic controller. When the pool pump electronic controller was repaired, updated or replaced or when the energy provider's control device was repaired, updated or replaced, a different separate communicating/translating device may be required.

The present invention is directed to alleviate at least some of these problems with the prior art.

BRIEF DESCRIPTION OF THE INVENTION

According to an embodiment of the invention, a system for managing commands for a pump electric motor for powering a pump for use in one of a pool and a spa is provided. The system includes a user interface for receiving user commands from a user and a pump motor controller for controlling the pump electric motor. The user interface and/or the pump motor controller is adapted to receive first protocol commands utilizing a first protocol from a first input source and is adapted to send first input source signals corresponding to the first protocol commands to a portion of the pump motor controller. The user interface and/or the pump motor controller are further adapted to receive second protocol commands utilizing a second protocol from a second input source and adapted to send second input source signals corresponding to the second protocol commands to a portion of the pump motor controller.

According to an aspect of the present invention, the system may be adapted wherein the pump motor controller is adapted to select the first protocol command or the second protocol command based on a predetermined priority structure.

According to another aspect of the present invention, the system may be adapted wherein the predetermined priority structure includes giving priority to all messages utilizing the first protocol.

According to yet another aspect of the present invention, the system may be adapted wherein the predetermined priority structure includes at least one of message structure, message checksum, message data length, and message baud rate.

According to yet another aspect of the present invention, the system may be adapted wherein the predetermined priority structure includes at least two of message structure, message checksum, message data length, and message baud rate.

According to yet another aspect of the present invention, the system may be adapted wherein the first input source is from a utility.

According to yet another aspect of the present invention, the system may further include a communication port operably associated with the pump motor controller. The system may be adapted wherein at least one of the user interface and the pump motor controller are adapted to continuously monitor the communication port for first protocol commands.

According to yet another aspect of the present invention, the system may be adapted wherein the pump motor controller is programmed for a plurality of protocols including at least the first protocol and the second protocol.

According to yet another aspect of the present invention, the system may be adapted wherein the pump motor controller determines the command for each protocol and wherein the pomp motor controller selects one of the commands and sends a signal to the motor to operate according to that command.

According to yet another aspect of the present invention, the system may be adapted wherein the motor includes a specific address and the user interface and/or the pump motor controller is adapted to buffer all input source signals assigned to the motor's specific address.

According to yet another aspect of the present invention, the system may be adapted wherein the first protocol includes a first baud rate and the second protocol includes a second baud rate. The second band rate is substantially different from the first baud rate. The system may be further adapted wherein the pump motor controller communicates with at the first protocol at the first baud rate and/or with the second protocol at the second baud rate.

According to another embodiment of the present invention, an electric motor assembly for use to power a device is provided. The electric motor assembly includes a motor adapted to be connected to the device, a device motor controller for controlling the motor, and a user interface. The user interface and/or the device motor controller is adapted to receive first instructions using a first protocol and is adapted to receive second instructions using a second protocol. The user interface and/or the device motor controller is adapted to send first motor operating signals corresponding to the first instructions. The user interface and/or the device motor controller is further adapted to send second motor operating signals corresponding to the second instructions. The device motor controller is adapted to operate the motor based on a selected one of the first instructions and the second instructions based on a predetermined priority structure.

According to another aspect of the present invention, the assembly may be adapted wherein the predetermined priority structure includes at least one of message structure, message checksum, message data length, and message baud rate.

According to yet another aspect of the present invention, the assembly may be adapted wherein the predetermined priority structure includes message structure, message checksum, message data length, and message baud rate.

According to yet another aspect of the present invention, the assembly may be adapted wherein the predetermined priority structure includes giving priority to all instructions utilizing the second protocol.

According to yet another aspect of the present invention, the assembly may further include a communication port operably associated with the device motor controller. Further, the assembly may be adapted wherein the user interface and/or the device motor controller is adapted to continuously monitor the communication port for instructions.

According to yet another aspect of the present invention, the assembly may be adapted wherein the device motor controller is programmed for a plurality of protocols including at least the first protocol and the second protocol.

According to yet another aspect of the present invention, the assembly may be adapted wherein the device motor controller determines the instruction for each protocol and wherein the device motor controller selects one of the instruction and sends a signal to the motor to operate according to that instruction.

According to yet another aspect of the present invention, the system may be adapted wherein the motor includes a specific address and the user interface and/or the device motor controller may be adapted to buffer all incoming instructions assigned to the motor's specific address.

According to another embodiment of the present invention, a method for managing commands for an electric motor for powering a pump for use in one of a pool and a spa is provided. The method includes the steps of providing a motor controller for controlling the electric motor, receiving in the pump motor controller user commands from a user utilizing a first protocol, receiving in the pump motor controller utility commands from an utility utilizing a second protocol, and selecting one of the user commands and the utility commands based on a predetermined priority structure.

According to another aspect of the present invention, the method may be provided wherein the step of selecting one of the user commands and the utility commands includes selecting one of the user commands and the utility commands based upon at least one of message structure, message checksum, message data length, and message baud rate.

BRIEF DESCRIPTION OF THE DRAWINGS

FIG. 5 is a table used in the control logic of the controller of the of the pool pump assembly of FIG. 3, showing the pool and pool system inputs and outputs.

DETAILED DESCRIPTION OF THE INVENTION

Figure 1:
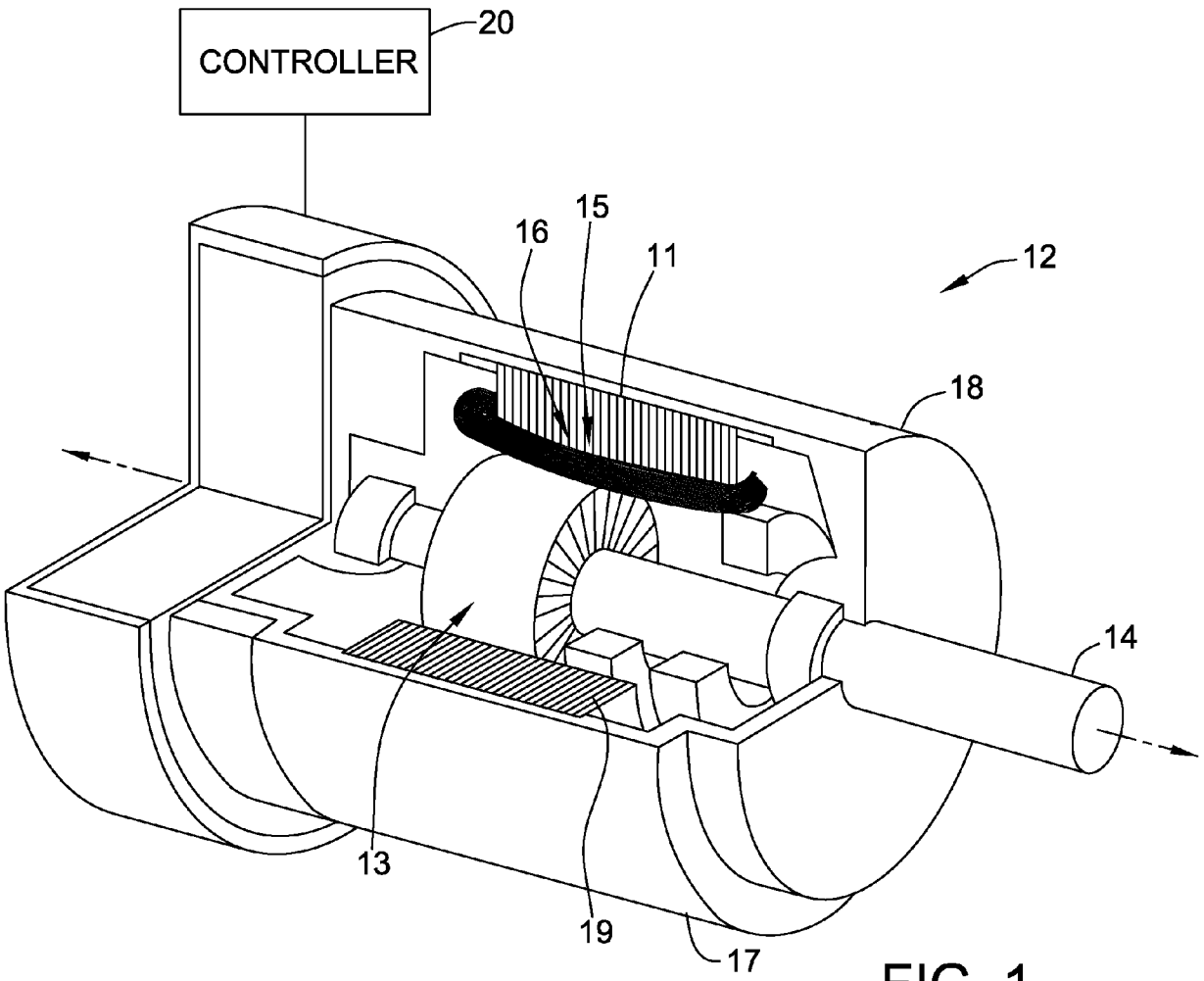
FIG. 1 is a perspective view, partially in cross section, of an embodiment of the present invention in the form of an electric motor assembly.

Pool and spa pumps are used to circulate water within the pool. The circulation of the water disperses chemicals added to the water to provide for acceptable water conditions. The circulation also permits the passage of water through a filter to remove impurities from the water. Typically the pomp operates for a portion of the week, typically on a schedule. The pump is typically powered by an electrical motor. The motor may be manually operated, wherein the operator manually controls the pump weekly cycle by manually turning the pump motor off and on.

Energy consumption tends to vary during different days of the week and different times of the day. Energy provided by the energy providers must be capable of meeting the demands of the times of highest energy consumption. Due to the enormous capital expenses required to provide electrical power to residential consumers, energy providers have devised methodologies to discourage energy use at those times of highest energy consumption.

Among the methodologies to discourage energy use at those times of highest energy consumption are control devices supplied by the energy provider. Such control devices are connected to the residential consumers power supply and may be used to reduce or curtail certain energy use by the consumer. These control devices communicate with the power loads of the consumer.

Pool and spa pump motors are one power load for which energy consumption can be scheduled for use at times of lower energy consumption or be reduced at periods of higher energy use. Scheduling such consumption can be difficult or inconvenient, particularly where the methodologies are complex.

Some even more sophisticated pool pump systems have electronic controllers located in or adjacent to the pool pump motors or within a pool system. These electronic controllers regulate the operation of the pool pump. These electronic controllers determine the on and off times of the pool pump motor. They may also control the speed of the pump if the pool pump motor has more than one possible speed.

These sophisticated electronic controllers may communicate with the control devices supplied by the energy provider. Such communication is done using a protocol provided by the energy provider. A number of protocols are available for such communications between the energy provider's control devices and pool pump electronic controllers. Typically a pool pump electronic controller would need a separate communicating/translating device provided by the energy provider so that the energy provider's control device could communicate with the pool pump electronic controller. When the pool pump electronic controller was repaired, updated or replaced or when the energy provider's control device was repaired, updated or replaced, a different separate communicating/translating device may be required. The electrical motor typically includes a housing for containing and supporting a stator which is excited by an electrical source that excites an electromagnetic field in coils in the stator. The coils interact with a rotor rotatably supported in the housing to provide the mechanical rotational energy for the electrical machine.

Technical effects of the methods, systems, and apparatus described herein include at least one of reduced cost, improved serviceability, improved performance and quality and reduced labor costs.

The electric machine typically includes a housing for containing and supporting the stator. While the electrical components may be positioned in a separate control, spaced from the housing of the electric machine, typically, to reduce cost to reduce space requirements or for other reasons, at least a portion of the electrical components are positioned within the electric machine housing.

According to an embodiment of the present invention and referring to FIG. 1, an electric machine 12 is provided. The electric machine 12 may be an electric motor or an electric generator, but hereinafter will be described as an electric motor 12. It should be appreciated that the electric motor may be used to power any mechanism, for example, a pump, a cyclic drive, a compressor, a vehicle, a fan or a blower.

The electric motor 12 typically includes a centrally located motor shaft 14 that rotates relative to the motor 12. Electrical energy is applied to coils 15 within the motor 12. The coils 15 generate an electromagnetic field that cooperates with an electromagnetic field in rotor 13 mounted to the motor shaft 14. The coils 15 initiate relative motion between the shaft 14 and the motor 12 that transfers the power from the coils 15 to the shaft 14.

A stationary assembly 16, also referred to as a stator, includes stator core 11 and coils 15 or windings positioned around portions of the stator core. It is these coils to which energy is applied to initiate this relative motion which transfers the power to the shaft. These coils 15 are formed by winding wire (not shown), typically copper, aluminum or a combination thereof, about a central core to form the winding or coil. An electric current is directed through the coils 15 which induces a magnetic field. It is the magnetic field that initiates this relative motion which transfers the power to the shaft 14. The stator core 11 typically includes a plurality of stator core laminations 19 that define stator teeth (not shown) around which the coils 15 are wound.

Typically the motor 12 includes a housing 17 having an inner wall or surface that defines a motor cavity therein. The housing 17 may include a plurality of components and may be made of a suitable durable material, for example a metal, a polymer or a composite. The housing 17 may, as shown, include a cylindrical shell 18 and opposed end caps (not shown).

It should be appreciated that the housing of the motor may have any suitable shape. One common shape of a motor housing is that of a cylindrical solid, having a generally cylindrical cross section. The shaft on a motor with such a shape generally extends from an end of the motor.

The motor 12 may have any suitable size and shape and may be, for example, an induction motor, a permanent-split capacitor (PSC) motor, an electronically commutated motor (ECM) motor, or a switched reluctance motor. The motor 12 may, as shown, be a radial flux motor or may be an axial flux motor. The housing 17 may include protrusions, for example fins (not shown), for dissipation of heat. The motor 12 may also include a fan (not shown) positioned within housing 17. The motor 12 may be electronically controlled, particularly if the motor is an ECM motor, by, for example a motor controller 34. The motor controller 34 may be internally or externally mounted to the motor 12. Alternatively, the controller 20 may be spaced from the motor 12 and may, for example be a part of a system controller (not shown).

Figure 2:
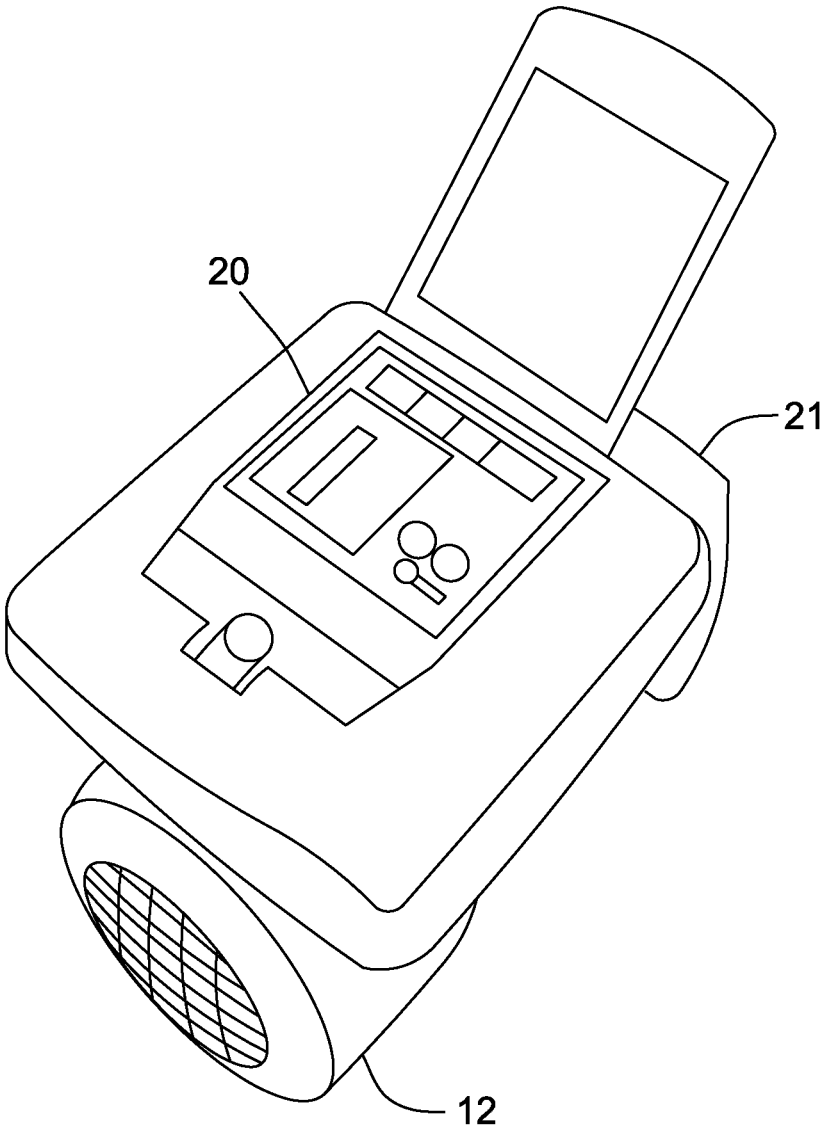
FIG. 2 is a schematic view of another embodiment of the present invention in the form of a motor controller for a motor.
Figure 3:
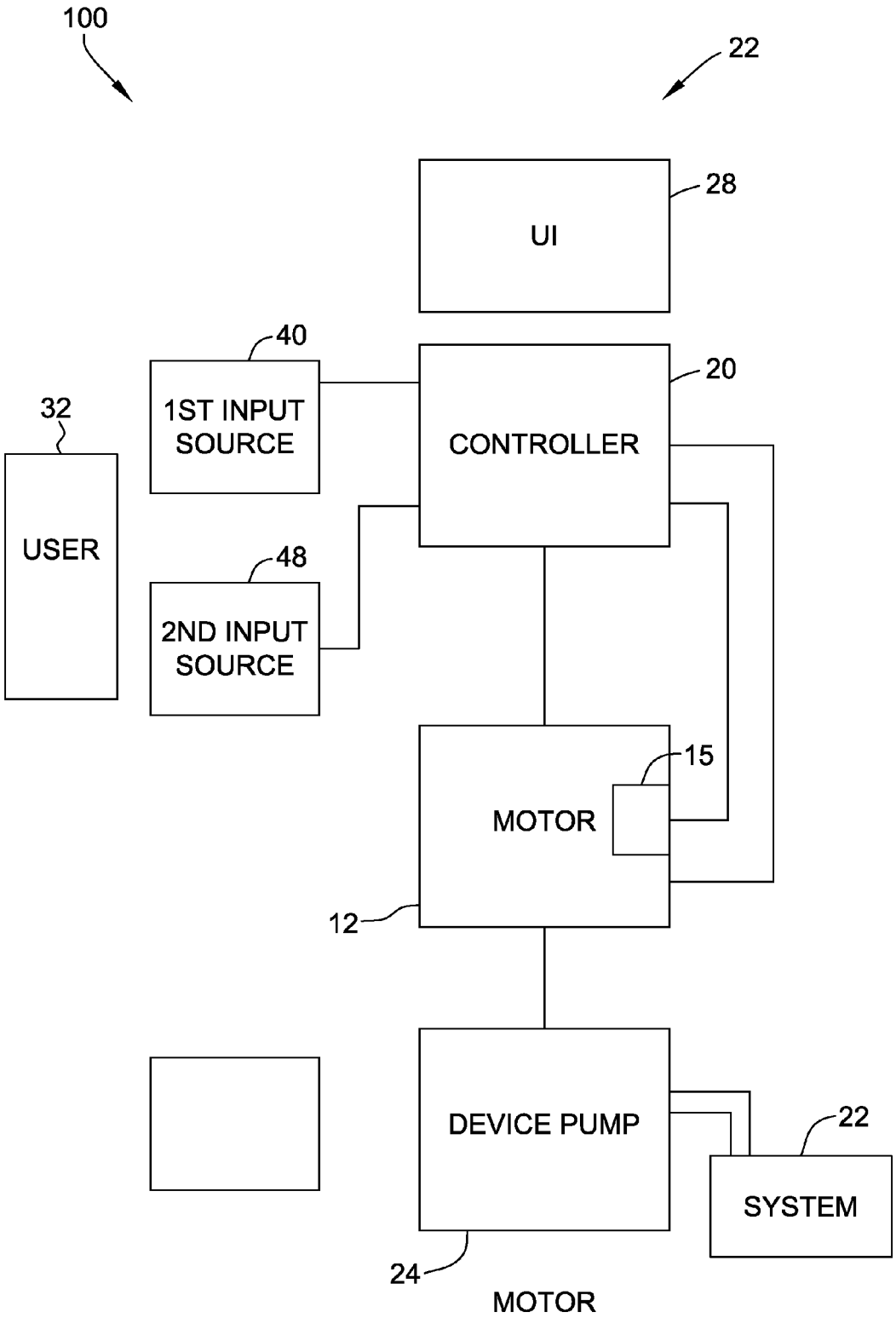
FIG. 3 is a perspective view, partially in cross section, of an embodiment of the present invention in the form of an pool pump assembly.
Figure 4:
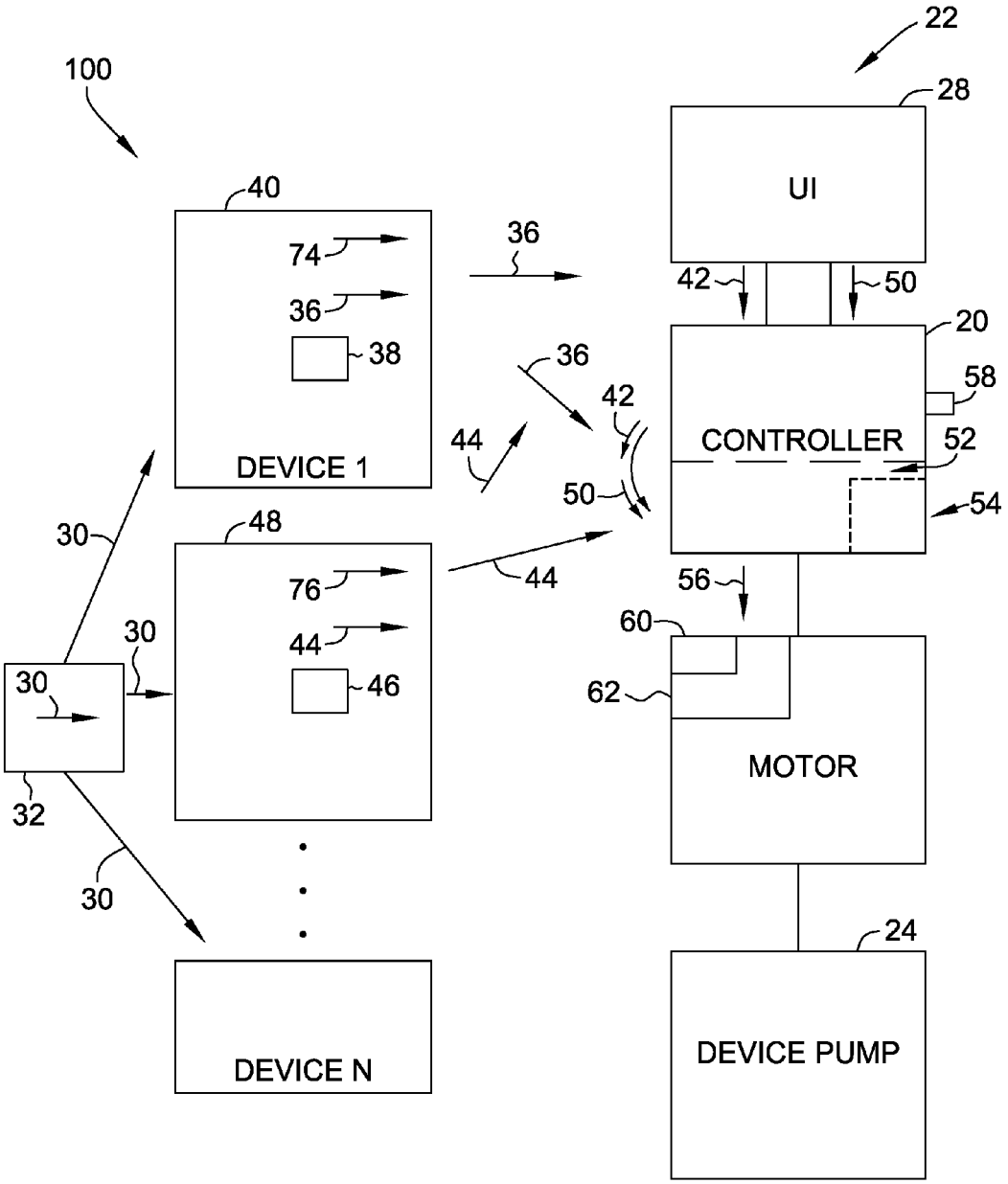
FIG. 4 is a schematic view of the pool pump assembly of FIG. 3.

According to an embodiment of the invention and referring now to FIGS. 2-4, a system 22 for managing commands or instructions for electric motor 12 for powering a device 24, for example a pump for use in a pool 26 is shown. It should be appreciated feat the system 22 may be used in a spa (not shown) or other liquid reservoir. The system includes a user interface 28 for receiving user commands or instructions 30 from a user 32 and motor controller 34 for controlling the electric motor 12. The user commands or instructions 30 may be in the form of first protocol commands or instructions 36. The user interface 28 and/or the motor controller 34 is adapted to receive the first protocol commands or instructions 36 utilizing a first protocol 38 from a first input source 40 and is adapted to send first input source signals 42 corresponding to the first protocol commands or instructions 36 to a portion of the motor controller 34. The user commands or instructions 30 may be in the form of second protocol commands or instructions 44. The user interface 28 and/or the motor controller 34 are further adapted to receive the second protocol commands or instructions 44 utilizing a second protocol 46 from a second input source 48 and adapted to send second input source signals 50 corresponding to the second protocol commands or instructions 44 to a portion 52 of the motor controller 34.

It should be appreciated that the first input source 40 and the second input source 48 may be any input sources. For example, the first input source 40 could be a first system controller for a HVAC unit or a pool. The second input source 48 could be a second system controller for a HVAC unit or a pool. In this scenario, a common motor 12, system controller 20 and user interface 28 could be provided for either the first system controller or the system controller. In this scenario, the user commands 30 would be the same as the first protocol commands 36 (if the motor was used with the first input source 40) or the same as the second protocol commands 36 (if the motor was used with the second input source 48). The consumer, HVAC company, the pool company, as well as the motor and controller company, would have a potential to reduce inventory and lower costs for such motors.

The system 22, in order to facilitate the use of the same motor with either the first input source 40 and the second input source 48, may be adapted wherein the motor controller 20 is programmed for a plurality of protocols including at least the first protocol 38 and the second protocol 46.

It should be appreciated that the first input source 40 may be a utility source/energy provider, for example a utility company control device supplied by the energy provider. Such control devices are connected to the residential consumers power supply and may be used to reduce or curtail certain energy use by the consumer from a device. The second input source 48 may be any input sources, for example, a system controller for a HVAC unit or a pool. Alternatively, second input source 48 may be may be in the form of the user interface 28.

Typically, a user utilizes a utility company control device supplied by the energy provider, the utility company control device is intended to have priority over any other control on the device(s) (user energy loads including HVAC, pool etc.) controlled by the utility company control device. The utility company control device is intended to turn oil or to turn down the users device(s) even if they would otherwise be on. To assist in giving priority to the utility company control device, the system 22 may be adapted wherein the motor controller 20 is adapted to select the first protocol command 36 or the second protocol command 44 based on a predetermined priority structure 54. As shown and described above the first protocol command 36 is for the first input source 40 and to accommodate the desire to give priority to the utility company control device, the first protocol command 36 may be given priority over tire second protocol command 44.

Various embodiments are possible for selecting the first protocol command 36 or the second protocol command 44 based on the predetermined priority structure 54. For example, the motor controller 20 may determine the command for each protocol. For example the motor controller 20 may determine the first protocol command 36 for the first protocol 38 and may determine the second protocol command 44 for the second protocol 46. Further, the motor controller 20 may select the first protocol command 36 or the second protocol command 44 and send an operating signal 56 to the motor 12 to operate according to that command. Note that for use with a utility company control device, the corresponding first protocol command 36, if any, would be sent. Note that for use with an application where the system 22 is used for motor 12 in one of a plurality of device systems, the corresponding protocol command of die device system, so given priority used would be sent.

The system 22 may further include a communication port 58 operably associated with the motor controller 20. The system 22 may be adapted wherein the user interface 28 and/or the motor controller 20 are adapted to continuously monitor the communication port for first protocol commands 36 and/or second protocol commands 44.

The system may be adapted wherein the motor 12 includes a specific address 60 and the user interface 28 and/or the motor controller 20 is adapted to buffer all input source signals including first input source signal 42 and second input source signal 50 assigned to the motor's specific address 60. The address 60 may be any address associated with the motor and may be in the motor controller 20, in the user interlace 28 or, as shown, in a motor circuit board 62. The buffering of the input source signals in the user interface 28 and/or the motor controller 20 may be done in any conventional manner.

Referring now to FIG. 5, the system 22 may be adapted wherein the predetermined priority structure 54 includes at least one of message structure 66, message checksum 68, message data length 70, and message baud rate 72.

Message structure 66 defines the detail of the bits used to form the message. The message structure 66 includes start bits, stop bits and parity bits. The structure of these bits defines the message structure 6. A message consists of the following parts: a header (or dome address) containing identifying and routing information, body (or command code) containing the actual content of the message and a stop or end (often having a checksum). The header contains identifying and routing information. Optional properties that can be used to convey additional identifying information beyond that contained in the header. The body contains the actual content of the message.

The message structure 66 may be used as a piece of information to help identify and determine the specific communication protocol. The controller 20 may have a predetermined priority structure based on a number of possible communication protocols.

Message checksum 68 is used as a password. The message sum, also known as a hash sum, is a small-size datum from a block of digital data for the purpose of detecting errors which may have been introduced during its transmission or storage. It is usually applied to an installation file after it is received from the download server. By themselves checksums are often used to verify data integrity, but should not be relied upon to also verify data authenticity. The actual procedure which yields the checksum, given a data input is called a checksum function or checksum algorithm. Depending on its design goals, a good checksum algorithm will usually output a significantly different value, even for small changes made to the input. This is especially true of cryptographic hash functions, which may be used to detect many data corruption errors and verify overall data integrity; if the computed checksum for the current data input matches the stored value of a previously computed checksum, there is a very high probability the data has not been accidentally altered or corrupted. Checksum functions are related to hash functions, fingerprints, randomization functions, and cryptographic hash functions. However, each of those concepts has different applications and therefore different design goals. Checksums are used as cryptographic primitives in larger authentication algorithms. For cryptographic systems with these two specific design goals.

The message checksum 68 may be used as a piece of information to help identify and determine the specific communication protocol. The controller 20 may have a predetermined priority structure based on a number of possible communication protocols.

The message data length 70 is the length in ms using a particular baud rate of the message. The message includes the dome address, the command code and the checksum.

The message data length 70 may used as a piece of information to help identify and determine the specific communication protocol. The controller 20 may have a predetermined priority structure based on a number of possible communication protocols.

The message baud rate 72 is defined as the modulation rate of data transmission and express it as bits per second.

The message baud rate 70 may be used as a piece of information to help identity and determine the specific communication protocol. The controller 20 may have a predetermined priority structure based on a number of possible communication protocols.

It should be appreciated that foe system 20 may be adapted wherein the first protocol 38 includes a first baud rate 74 and the second protocol 46 includes a second baud rate 76. The second baud rate 76 is substantially different from the first baud rate 74. The motor controller 20 may communicate with at the first protocol 38 at the first baud rate 74 and/or with the second protocol 46 at the second baud rate 76.

Referring to FIG. 5, the priority structure 54 may provide for a 1 or first priority for a utility protocol, a 2 or second priority for a first system provider protocol, a 3 or third priority for a second system providers, protocol, and a 4 or fourth priority for a motor supplier protocol. The system providers are those companies that use the motor supplier's motor in their system.

As shown in FIG. 5, the priority 1 command (the utility protocol command) is translated by the controller 20 to a translated motor supplier protocol command. As shown each utility protocol command is translated into a motor supplier protocol command. Examples of such commands are shown.

Referring again to FIGS. 1-5, an electric motor assembly 100 for use to power the device 24 is provided. The electric motor assembly 100 includes motor 12 adapted to be connected to the device 24, device motor controller 20 for controlling the motor 12, and user interface 28. The user interface 28 and/or the device motor controller 20 is adapted to receive first instructions 36 using first protocol 38 and is adapted to receive second instructions 44 using second protocol 46. The user interface 28 and/or the device motor controller 20 is adapted to send first motor operating signals 42 corresponding to the first instructions 36. The user interface 28 and/or the device motor controller 20 is further adapted to send second motor operating signals 50 corresponding to the second instructions 44. The device motor controller 20 is adapted to operate the motor 12 based on a selected one of the first instructions 36 and the second instructions 44 based on predetermined priority structure 54.

Figure 6:
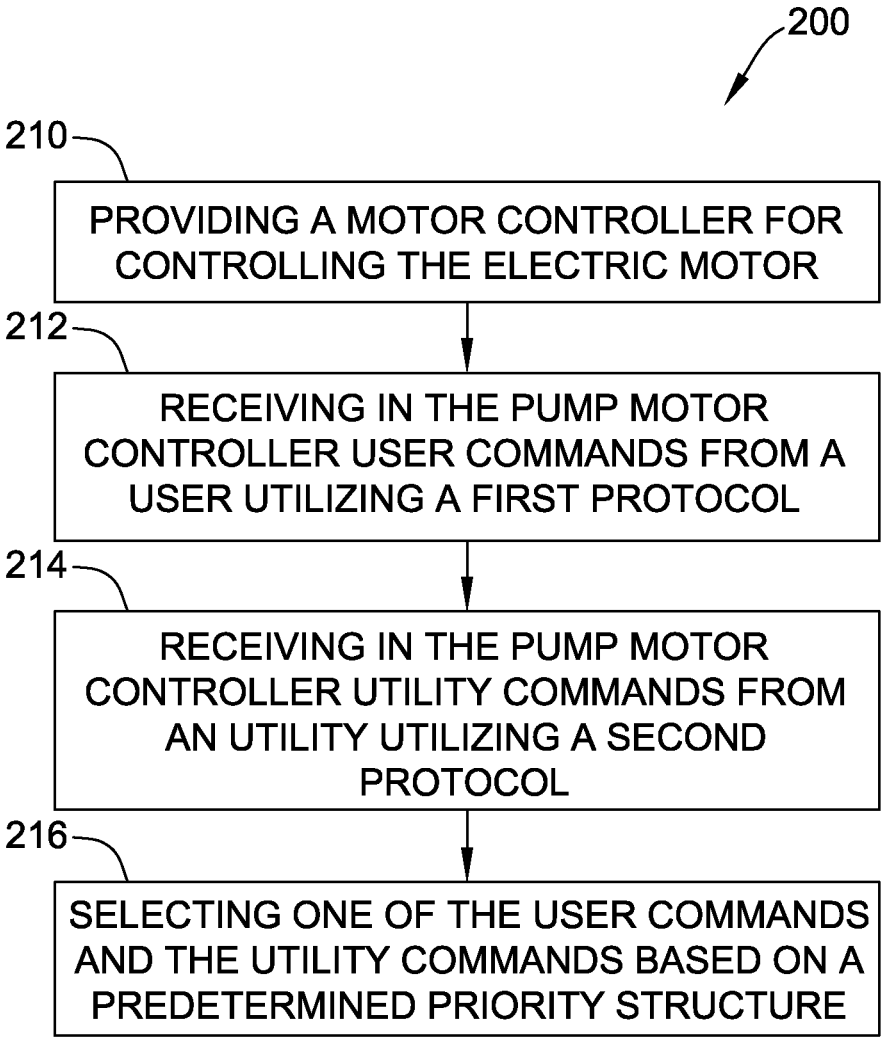
FIG. 6 is a flow chart of another embodiment of the present invention in the form of a method for providing controlling a motor.

Referring to FIG. 6, a method 200 for managing commands tor an electric motor for powering a pump for use in one of a pool and a spa is provided. The method 200 includes step 210 of providing a motor controller for controlling the electric motor, step 212 of receiving in the motor controller user commands from a user utilizing a first protocol, step 214 of receiving in the motor controller utility commands from m utility utilizing a second protocol, and step 216 of selecting one of the user commands and the utility commands based on a predetermined priority structure.

According to another aspect of the present invention, the method 200 may be provided wherein the step 216 of selecting one of the user commands and the utility commands includes selecting one of the user commands and the utility commands based upon at least one of message structure, message checksum, message data length, and message baud rate.

The methods, systems, and apparatus described herein facilitate efficient and economical assembly of an electric machine. Exemplary embodiments of methods, systems, and apparatus are described and/or illustrated herein in detail. The methods, systems, and apparatus are not limited to the specific embodiments described herein, hut rather, components of each apparatus and system, as well as steps of each method, may be utilized independently and separately from other components and steps described herein. Each component, and each method, step, can also be used in combination with other components and/or method steps.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing an improved method and motor controller that reduces or eliminates the efficiency loss caused by a less optimum operation of the pump motor. Furthermore, the exemplary methods system and apparatus achieve increased efficiency while reducing effort in optimizing the operation of the pump motor. The methods, system and apparatus described herein may be used in any suitable application. However, they are particularly suited for pump applications.

Exemplary embodiments of fee pool pump motor and controller are described above in detail. The electric machine and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

The methods, systems, and apparatus described herein facilitate pool pump motor scheduling of an electric machine. Exemplary embodiments of methods, systems, and apparatus are described and/or illustrated herein in detail. The methods, systems, and apparatus are not limited to the specific embodiments described herein, but rather, components of each apparatus and system, as well as steps of each method, may be utilized independently and separately from other components and steps described herein. Each component, and each method step, can also be used in combination with other components and/or method steps.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

Described herein are exemplary methods, systems and apparatus utilizing improved pool pump motor scheduling. Furthermore, the exemplary methods system and apparatus achieve improved pool pump motor scheduling. The methods, system and apparatus described herein may be used in any suitable application. However, they are particularly suited for pump applications.

Exemplary embodiments of the system, assembly and method are described above in detail. The electric machine and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

What is claimed is:

1. A system for managing commands for a pump electric motor for powering a pump for use is one of a pool and a spa, comprising:

a user interface for receiving user commands from a user;

a pump motor controller for controlling the pump electric motor, at least one of said user interface and said pump motor controller receiving first protocol commands utilizing a first protocol from a first input source and sending first input source signals corresponding to the first protocol commands from an energy supplier to a portion of the pump motor controller, at least one of said user interface and said pump motor controller receiving second protocol commands utilizing a second protocol from a second input source and sending second input source signals corresponding to the second protocol commands to a portion of the pump motor controller, at least one of said user interface and said pump motor controller receiving third protocol commands utilizing a third protocol from a third input source and sending third input source signals corresponding to the third protocol commands to a portion of the pump motor controller, at least one of said user interface and said pump motor controller selecting one of said first protocol command, said second protocol command, and said third protocol command based on a predetermined priority structure giving priority to all messages utilizing the first protocol, the predetermined priority structure including message structure, message checksum, message data length, and message baud rate, the second protocol for a first pump manufacturer and the third protocol for a second pump manufacturer; and a communication port operably associated with said pump motor controller, said user interface and said pump motor controller monitoring said communication port for the first protocol command.

2. The system according to claim 1, wherein said pump motor controller determines the command for each protocol; and wherein the pump motor controller selects one of the commands and sends a signal to the motor to operate according to that command.

3. The system according to claim 1, wherein the motor comprises a specific address; and wherein at least one of said user interface and said pump motor controller is adapted to buffer all input source signals assigned to the motor's specific address.

4. The system according to claim 1, wherein said first protocol comprises a first baud rate and said second protocol comprises a second baud rate, said second baud rate being substantially different from said first baud rate; and wherein the pump motor controller communicates with at least one of said first protocol at said first baud rate and said second protocol at said second baud rate.

5. The system according to claim 1, wherein the energy supplier is an electric utility company.

6. The system according to claim 1, wherein said pump motor controller monitoring said communication port for the first protocol command comprises wherein said pump motor controller continuously monitors said communication port for the first protocol command.

7. The system according to claim 1, wherein at least one of said user interface and said pump motor controller further receiving fourth protocol commands utilizing a fourth protocol from a fourth input source and sending fourth input source signals corresponding to the fourth protocol commands to a portion of said pump motor controller, at least one of said user interface and said pump motor controller selecting one of said first protocol command, said second protocol command, said third protocol command and said fourth protocol command based on a predetermined priority structure giving priority to all messages utilizing the first protocol, the predetermined priority structure including message structure, message checksum, message data length, and message baud rate the fourth protocol for a pump motor manufacturer.

8. An electric motor assembly for use to power a device, comprising:

a motor adapted to be connected to the device;

a device motor controller for controlling said motor;

a user interface, at least one of said user interface and said device motor controller adapted to receive first instructions from an energy supplier using a first protocol from a first input source, receive second instructions using a second protocol from a second input source, and receive third instructions using a third protocol from a third input source, at least one of said user interface and said device motor controller is adapted to send first motor operating signals corresponding to the first instructions, at least one of said user interface and said device motor controller is adapted to send second motor operating signals corresponding to the second instructions, at least one of said user interface and said device motor controller is adapted to send third motor operating signals corresponding to the third instructions, said device motor controller adapted to operate said motor based on a selected one of the first instructions, the second instructions, and the third instructions based on a predetermined priority structure giving priority to all messages utilizing the first protocol, the predetermined priority structure including message structure, message checksum, message data length, and message baud rate, the second protocol for a first pump manufacturer and the third protocol for a second pump manufacturer; and a communication port operably associated with said pump motor controller, said user interface and said pump motor controller adapted to continuously monitor said communication port for the first protocol.

9. The assembly according to claim 8, wherein, said device motor controller determines the instruction for each protocol; and wherein the device motor controller selects one of the instructions and sends a signal to the motor to operate according to that instruction.

10. The assembly according to claim 8, wherein the motor comprises a specific address; and wherein at least one of said user interface and said device motor controller is adapted to buffer all input source signals assigned to the motor's specific address.

11. The assembly according to claim 8, wherein the first input source is an electric utility company.

12. The assembly according to claim 8, wherein at least one of said user interface and said pump motor controller further receiving fourth instructions utilizing a fourth protocol from a fourth input source and sending fourth input source signals corresponding to the fourth instructions to a portion of said pump motor controller, at least one of said user interface and said pump motor controller selecting one of said first instructions, said second instructions, said third instructions and said fourth instructions based on a predetermined priority structure giving priority to all messages utilizing the first protocol, the predetermined priority structure including message structure, message checksum, message data length, and message baud rate, the fourth protocol for a pump motor manufacturer.

13. A method for managing commands for an electric motor for powering a pump for use in one of a pool and a spa, comprising:

providing a motor controller for controlling the electric motor;

receiving in the pump motor controller user commands from a user utilizing a first protocol;

receiving in the pump motor controller utility commands from a utility utilizing a second protocol;

receiving in the pump motor controller manufacturer commands from a manufacturer utilizing a third protocol;

selecting one of the user commands, the utility commands and the manufacturer commands based on a predetermined priority structure;

giving priority to all messages utilizing the first protocol, the predetermined priority structure including message structure, message checksum, message data length, and message baud rate;

sending from the pump motor controller operating signals corresponding to one of the user commands, the utility commands, and the manufacturer commands;

providing a communication port operably associated with said pump motor controller; and continuously monitoring, with the user interface and the pump motor controller, the communication port for the first protocol command.

* * * * *